United States Patent [19]

Wolters et al.

[11] Patent Number: 4,870,908

[45] Date of Patent: Oct. 3, 1989

[54] OFFICE SPACE DIVIDING SYSTEM

[75] Inventors: Richard H. Wolters, Grand Rapids Twp., Kent County, Mich.; Gerald A. Thoeming, Crete, Ill.; Robert E. Jeffers, Ada, Mich.

[73] Assignee: Westinghouse Electric Corp., Pittsburgh, Pa.

[21] Appl. No.: 215,115

[22] Filed: Jul. 5, 1988

[51] Int. Cl.[4] ..... A47B 57/00

[52] U.S. Cl. ..... 108/60; 160/37; 49/372

[58] Field of Search ..... 49/372, 373, 374; 160/37; 108/60, 64; 312/196

[56] References Cited

U.S. PATENT DOCUMENTS

| | | | |
|---|---|---|---|
| 2,235,454 | 3/1941 | Koropchak | 160/37 |
| 2,375,349 | 5/1945 | Collins | 49/373 |
| 2,779,401 | 1/1957 | Bascom | 160/37 |
| 3,728,801 | 4/1973 | Beckman | 312/196 |
| 3,906,669 | 9/1975 | Vorguitch | 49/372 |
| 3,931,771 | 1/1976 | Kramer | 108/60 X |
| 4,706,572 | 11/1987 | Priesemuth | 108/60 |

FOREIGN PATENT DOCUMENTS

| | | | |
|---|---|---|---|
| 14923 | 6/1912 | United Kingdom | 49/373 |

*Primary Examiner*—Peter A. Aschenbrenner
*Attorney, Agent, or Firm*—D. R. Lackey

[57] ABSTRACT

An office space dividing system having at least first and second work stations having horizontally oriented work surfaces separated by a barrier panel having first and second sides and an opening in the panel which is adjacent to and above the work surfaces. A convertible panel is mounted in the opening of the barrier panel, for slideable engagement therewith. The convertible panel is operable between open and closed positions, from either side of the barrier panel, with the convertible panel being nonremovable from the barrier panel during normal usage. Also, or alternatively, a convertible panel may be provided below the work surfaces for selectively improving ventilation and air flow between the work stations.

26 Claims, 8 Drawing Sheets

FIG. 10
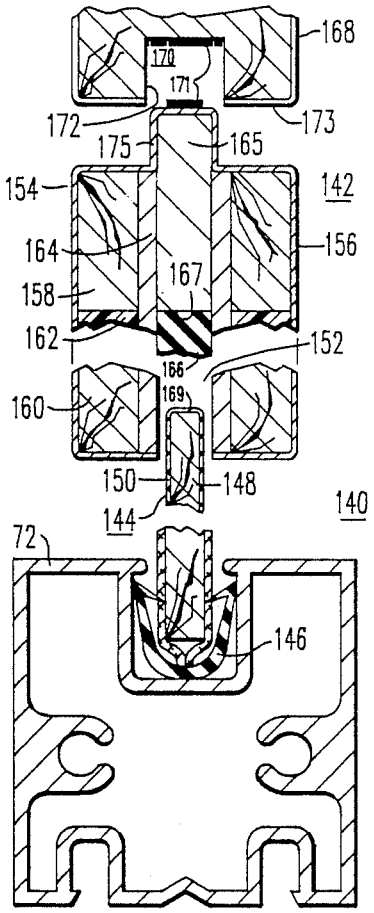
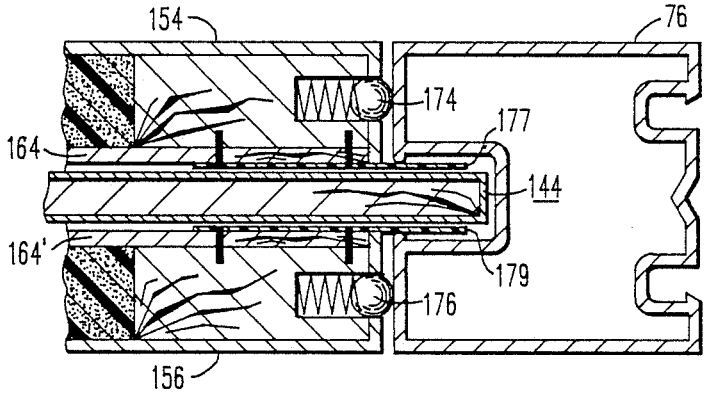
FIG. 11

OFFICE SPACE DIVIDING SYSTEM

BACKGROUND OF THE INVENTION

1. Field of the Invention

The invention relates to office space dividing systems, and more specifically to an arrangement for increasing the versatility of office space dividing systems.

2. Description of Prior Art:

Open building floor space may be quickly converted to a plurality of private work stations by interior space dividing systems, such as disclosed in U.S. Pat. No. 3,762,116, which is assigned to the same assignee as the present application. Such systems readily allow horizontal work surfaces to be suspended from opposite sides of barrier panels to provide small private cubicles which effectively utilize the amount of floor space available. The primary purpose of the work stations is privacy, and the panel height, such as 60, 65 or 80 inches, is selected for the particular degree of privacy required by the work functions to be performed. Communication, when required, between occupants of the work stations, is accomplished by an occupant physically leaving a work station and entering a work station of another, or several occupants leaving their work stations and gathering in a conference room.

SUMMARY OF THE INVENTION

The present invention increases the versatility of modern office space dividing systems by providing one or more convertible panels in a common wall of adjacent work stations. A barrier panel of a common wall is provided with an opening which is disposed above work surfaces disposed on opposite sides of a common wall. The opening is dimensioned to provide visual and acoustical communication between seated persons, from work surface level to at least eye level. Convertible panel means is arranged for vertically slidable movement within the frame of the barrier panel, with the convertible panel means being manually operable by occupants of work stations on either side of the convertible panel means, to open or close the barrier opening. The convertible panel means does not encumber the work space, as it is captured by the barrier panel frame such that the barrier panel means is non-removable therefrom during normal usage. Thus, the convertible panel means is self storing, regardless of its position relative to the barrier opening.

Two or more private adjacent work stations may quickly become a small conference room without the occupants having to leave their chairs. For example, when the office space dividing system is arranged in hexagons, three private work stations may quickly become one large conference room by providing convertible panels in the common barrier walls of three adjacent hexagons.

While the primary usage of the convertible panel of the invention is to open and close an opening disposed above work surfaces, a convertible panel may also be used below work surfaces to selectively allow air flow between work stations.

BRIEF DESCRIPTION OF THE DRAWINGS

The invention may be better understood and further advantages and uses thereof more readily apparent when considered in view of the following detailed description of exemplary embodiments, taken with the accompanying drawings, in which:

FIG. 10 is a cross-sectional view of the barrier panel shown in FIG. 9, taken between and in the direction of arrows X—X in FIG. 9, with the convertible panel member in a partially open position;

FIG. 11 is a cross-sectional view of the barrier panel member shown in FIG. 9, taken between and in the direction of arrows XI—XI in FIG. 9;

DESCRIPTION OF PREFERRED EMBODIMENTS

The present invention applies to office space dividing systems having two or more work areas or stations which share common walls constructed of barrier panels, with the adjacent work stations all having square, rectangular, or polygonal configurations, or any combination thereof. For purposes of example, the invention will be described relative to an office space dividing system having adjacent polygonal work stations.

Figure 1:
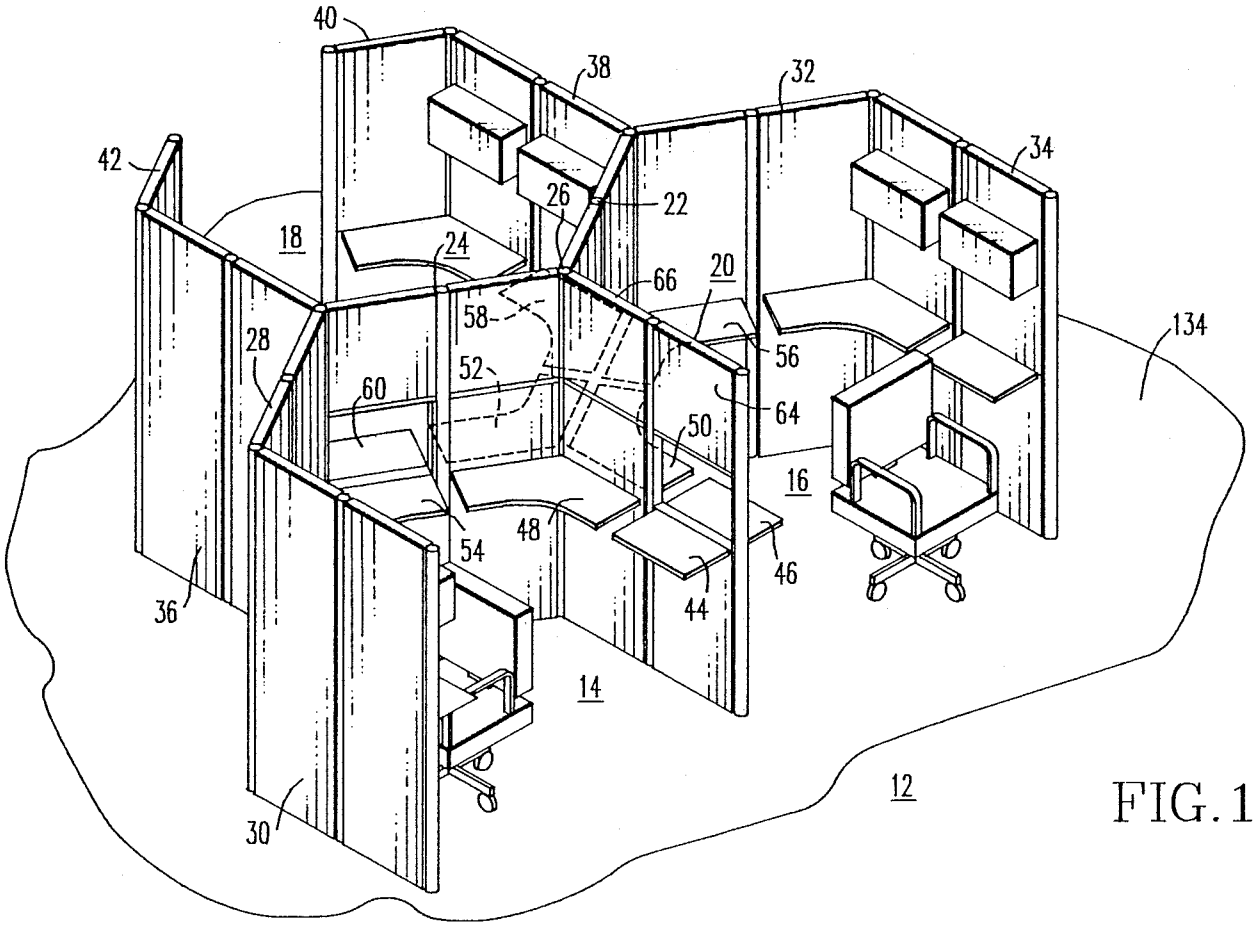
FIG. 1 is a perspective view of an office space dividing system having a group of work stations constructed according to the teachings of the invention.

Referring now to the drawings, and to FIG. 1 in particular, there is shown an office space dividing system 12 constructed according to the teachings of the invention. Office space dividing system 12 includes a plurality of hexagonal work areas or stations, with three work stations 14, 16 and 18, being shown for purposes of example.

The corner stone of the three pologonal work stations includes three walls 20, 22 and 24 arranged to have a common corner 26 and 120 degree angles between any two adjacent walls. Additional walls may then continue from the outer ends of the three basic walls 20, 22 and 24 to complete work stations 14, 16 and 18. For example, work station 14 includes additional walls 28 and 30, work station 16 includes additional walls 32 and 34, and work station 18 includes additional walls 36, 38, 40 and 42.

Each of the work stations 14, 16 and 18 includes horizontally oriented work surfaces, which may be suspended from the surrounding walls. For example, work station 14 includes a work surface 44 suspended from one side of wall 20, and work station 16 includes a work surface 46 suspended from the remaining side of wall 20, directly opposite the location of work surface 44. Work station 14 includes a horizontal work surface 48 suspended from walls 20 and 24, work station 16 includes a work surface 50 suspended from walls 20 and 22, and work station 18 includes a work surface 52 suspended from walls 22 and 24. Additional work surfaces which share a common wall with a work surface in an adjoining work station include a work surface 54 in work station 14, a work surface 56 in work station 16, and work surfaces 58 and 60 in work station 18.

In a preferred embodiment of the invention, the basic walls 20, 22 and 24, i.e., those walls which have work stations on each of their first and second opposite sides, include barrier panel modules constructed of metallic frames having one or more fixed, non-removable insert panels, and at least one movable, non-removable panel which will be called a convertible panel. The remaining walls of the work stations which either do not have work stations on both sides, or common walls in which it is not desired to have convertible panels, may be of conventional panel construction. Each such basic wall is preferably constructed of barrier panel modules suitably joined together with joining means, such as the joining means illustrated in the hereinbefore mentioned U.S. Pat. No. 3,762,116, which includes posts and hooks. Since the specific joining arrangement forms no part of the present invention, no joining arrangement is illustrated. Each barrier module extends for the full height of the walls between the work stations, such as 60, 65 or 80 inches, and may have any desirable width, with three feet being an example of a commonly used width. Wall 20, for example, is illustrated as having two barrier modules 64 and 66 each having a width of three feet. Barrier module 64 is illustrated with an upper convertible panel member in an open position, and barrier module 66 is illustrated with an upper convertible panel member in a closed position. Since all of the barrier modules of the common walls may be of like construction, only barrier module 64 will be described in detail.

Figure 2:
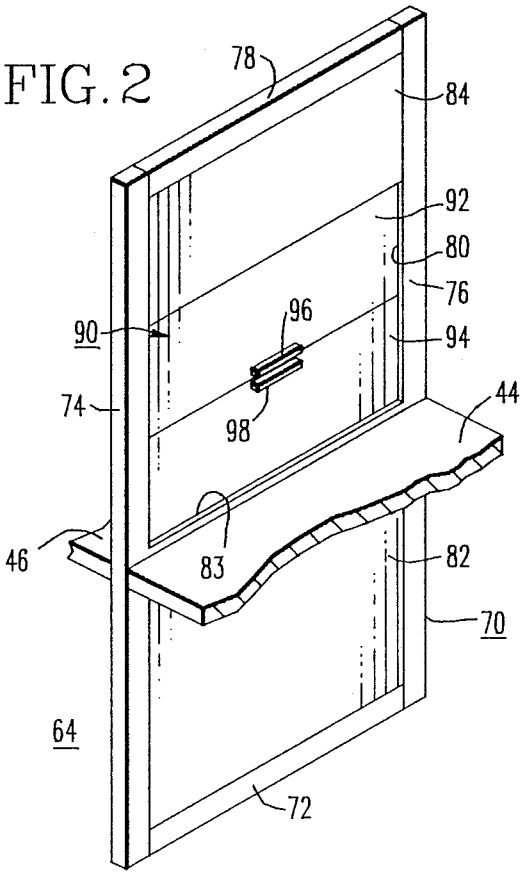
FIG. 2 is a perspective view of a barrier panel constructed according to a first embodiment of the invention, which may be used in the office space dividing system shown in FIG. 1.

FIG. 2 is a perspective view of barrier module 64 constructed according to a first embodiment of the invention which is suitable for relatively high barriers, such as 80 inch high barriers. Barrier module 64 includes a metallic frame 70 having suitably interconnected frame portions or members which include a bottom 72, first and second upstanding sides or stiles 74 and 76, respectively, and a top 78. The bottom, sides and top portions of frame 70 may be aluminum extrusions, for example.

Barrier module 64 includes an opening 80 defined by frame 70 and one or more fixed panel inserts, with the number of fixed panel inserts depending upon the height of barrier module 64. With an 80 inch high barrier module, frame 70 would have lower and upper panel inserts 82 and 84, respectively. The lower panel insert 82 of frame 70, in this embodiment, will usually be fixed, but later embodiments will illustrate slidable lower panel inserts. Lower panel insert 82 is dimensioned such that its upper edge 83 is about work surface height, e.g., about 28 to 30 inches above floor level, for example. The upper panel insert 84 will usually be fixed. The height dimension of opening 80 is selected for easy visual and acoustical communication between seated persons in adjacent work stations, e.g., about 24 to 28 inches, for example.

Opening 80 is provided with convertible panel means 90. The function of convertible panel means 90 is to open and close opening 80 in barrier module 64. While the movement of convertible panel means 90 may be accomplished by a motor or cylinder driven mechanism, for example, in a preferred embodiment of the invention the movement is manually initiated, and all embodiments will be so described. Further aspects of the invention which are common to all embodiments include the fact that the convertible panel, means 90 includes one or more vertically slidable panels, with the slidable panels being non-removable from frame 70 during normal operation of the convertible panel means. Further, the convertible panel means 90, being non-removable, is self-storing in either the open or closed positions of the convertible panel means. Still further, the convertible panel means 90 may be operated with equal ease from either side of the barrier module 64, and operation thereof requires no cleaning off of the adjacent work surfaces to function. Further, the convertible panel means 90 is preferably of similar appearance to panel inserts 82 and 84, blending in with the decor of panel inserts 82 and 84, as well as with the decor of barrier panel modules which are not equipped with the convertible panel means 90.

As hereinbefore stated, the embodiment of FIG. 2 is specifically for barrier modules having a height dimension of at least about 80 inches. In the FIG. 2 embodiment the convertible panel means 90 includes upper and lower bi-parting panel members 92 and 94, respectively. The upper fixed panel insert 84 provided above opening 80 includes a pocket into which the upper vertically slidable panel member 92 may be moved, and the lower panel insert 82 includes a pocket into which the lower vertically slidable panel member 94 may be moved. The upper and lower vertically slidable panel members 92 and 94 may include handles 96 and 98, respectively, for manually actuating each movable panel member. Latch means for holding panel members 92 and 94 together, and for holding panel member 92 in an open position, may include magnets, Velcro, bullet catches, spring clips, and the like, with exemplary latch means which may be used being hereinafter described relative to other embodiments of the invention.

In a preferred embodiment of the invention, the convertible panel means 90 includes a single slidable panel member. This single slidable panel member may be similar to the upper panel member 92, or it may be similar to the lower panel member 94. In a preferred embodiment of the invention, this single slidable panel member is preferably moved vertically upward to close opening 80, and vertically downward to open opening 80. Thus, in FIG. 2 , only the lower panel member 94 would be used in the preferred embodiment. When used alone, panel member 94 may be used with any barrier module height. For example, with 60 and 65 inch high barrier modules, the upper fixed panel insert 84 would have a small height dimension, or upper panel insert 84 may be eliminated.

The vertically downward movement of panel member 94 is preferred for exposing opening 80, as gravity will assist movement of panel member 94 to the open position, and when panel member 94 is in the open position, gravity will maintain this position. Thus, panel member 94 cannot accidentally fall and close the opening, as would be the case where a vertically slidable member is moved upwardly to reveal opening 80.

Figure 3:
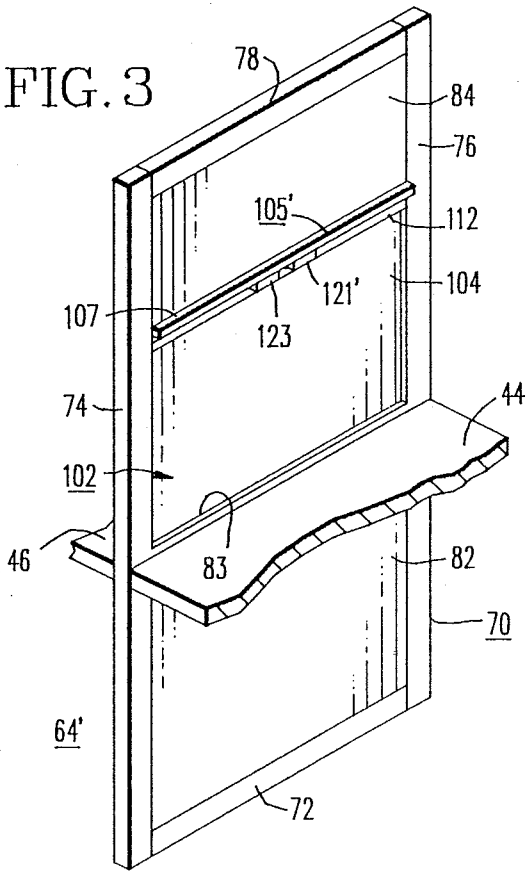
FIG. 3 is a perspective view of a barrier panel constructed according to another embodiment of the invention.

A preferred embodiment of the invention having a single slidable panel member disposed above a work surface is illustrated in a barrier module 64' shown in perspective in FIG. 3, with like reference numerals in FIGS. 2 and 3, as well as in the remaining Figures, indicating like components which will not be described again. Barrier module 64' includes convertible panel means 102 having a single vertically slidable panel member 104. The height of the upper fixed panel insert 84 is selected according to the overall height of barrier module 64', and as hereinbefore stated, it may be eliminated in relatively short barrier panel modules.

Figure 4:
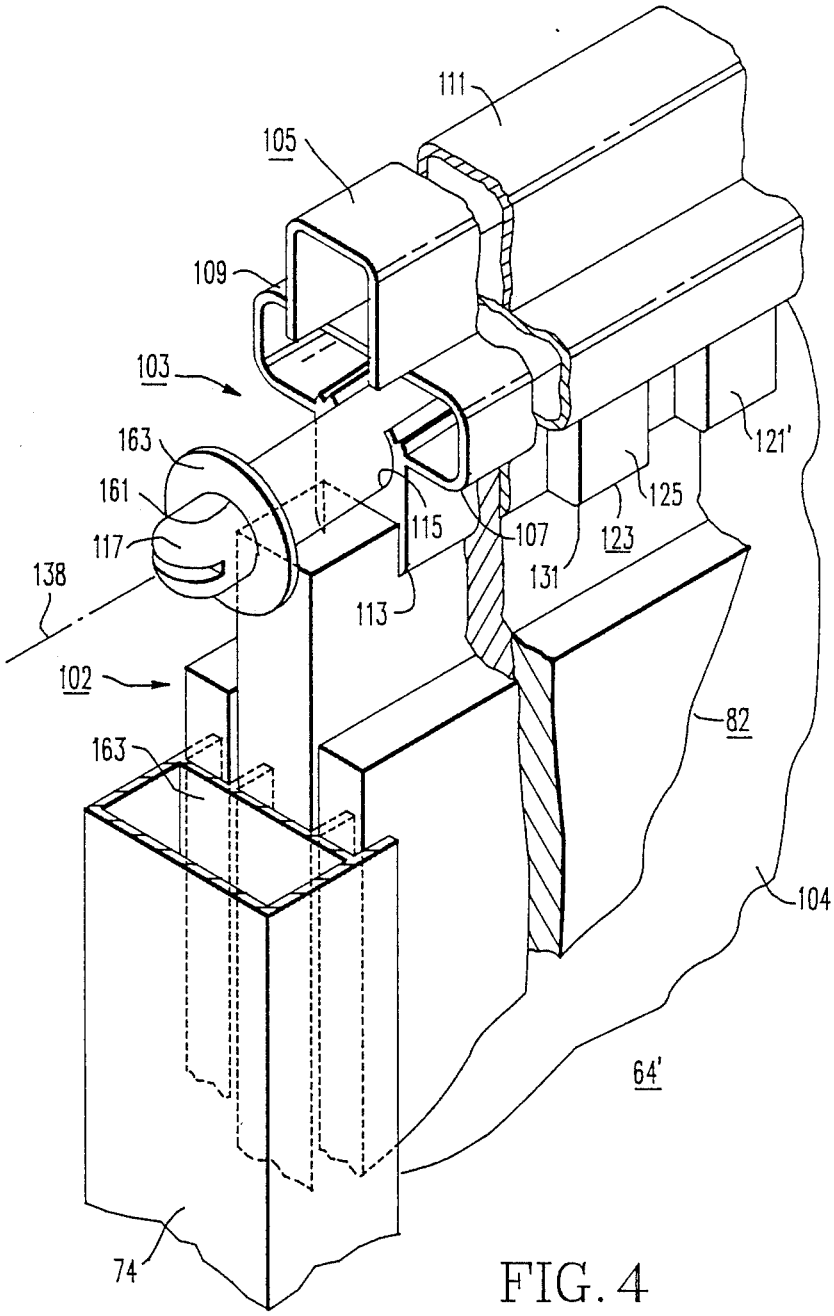
FIG. 4 is a perspective view, with parts cut away, of the barrier module or panel shown in FIG. 3, illustrating a preferred latching arrangement.
Figure 5:
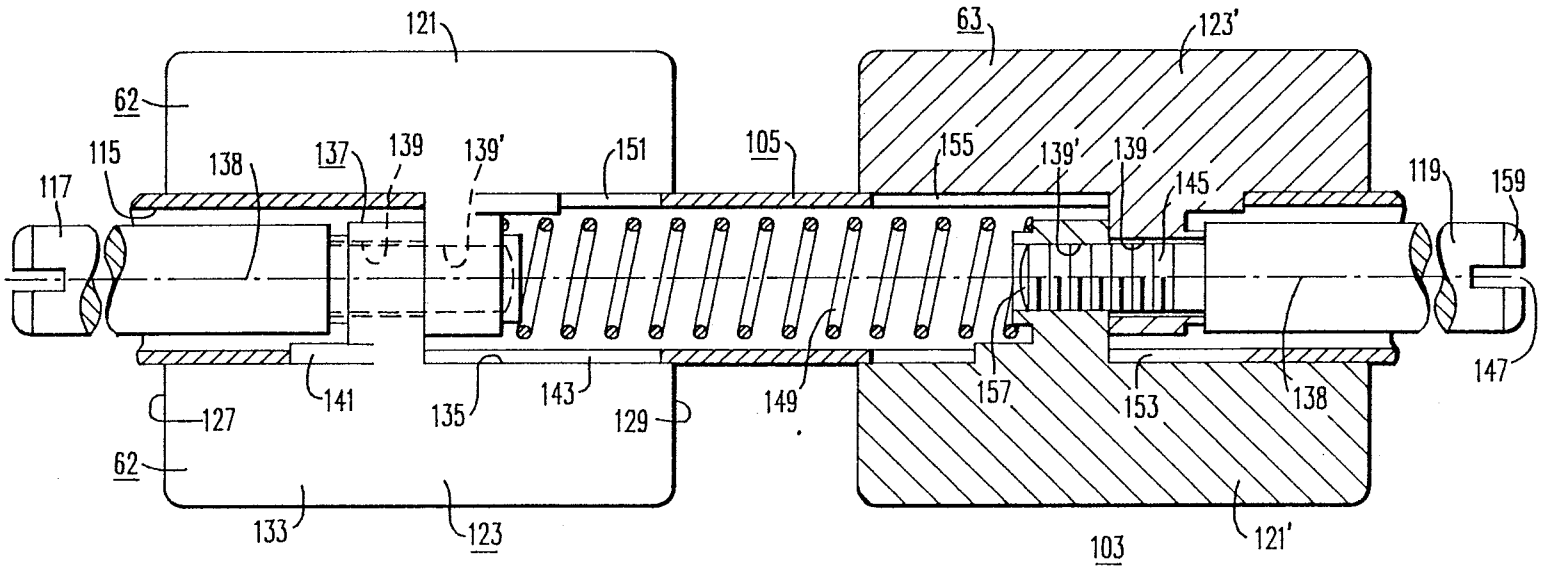
FIG. 5 is a plan view, partially in section, of the latching arrangement shown in FIG. 4.

FIG. 4 is a fragmentary perspective view of barrier module 64', with parts broken away, illustrating a preferred latching arrangement 103 which may be used. FIG. 5 is a plan view of latching arrangement 103, shown partially in section. Latching arrangement 103 is operable from either side of barrier module 64' by a metallic extrusion 105 which includes:

(1) first and second lateral projections 107 and 109, respectively, which function as handles on opposite sides of barrier module 64';

(2) an upper projection 111 which cooperates with a recess in upper panel insert 84, or with a recess in top frame member 78 when insert 84 is not utilized, to function as a sight and sound guard or barrier;

(3) a lower channel shaped projection 113 having an upwardly extending recess for receiving and fixing extrusion 105 to the upper edge of the slidable panel member 104; and (4) a central cylindrical opening 115 disposed above the lower channel shaped projection 113.

First and second rods 117 and 119, respectively, are disposed in opening 115, with the first rod 117 being associated with a first cooperative pair 62 of actuator members, which pair includes first and second actuator members 121 and 123. The second rod 119 is associated with a second cooperative pair 63 of actuator members, which pair includes first and second actuator members 121' and 123'. Members 121 and 121' are of like final construction, and members 123 and 123' are of like final construction. The initial configurations and dimensions of all four actuator members 121, 121', 123 and 123' are identical, with the initial configurations being formed by molding the parts from powdered metal, for example.

More specifically, each actuator member, such as actuator member 123, has a rectangularly shaped, outwardly facing surface 125, first and second side surfaces 127 and 129, a bottom surface 131, a top surface 133, and an inwardly facing surface 135. A projection 137 is provided on inwardly facing surface 135 which defines an opening 139 having an axis aligned with the longitudinal axes 138 of rods 117 and 119. Projection 137 includes a guide portion 141 configured and dimensioned to slide in an elongated slot 143 formed in extrusion 105 which communicates with opening 115. Slot 143, which is elongated in the direction of axes 138, is curved at each end, and portion 141 is similarly curved to extend into the curved end of slot 143 when portion 141 is actuated to an end of slot 143.

The difference between actuator members 121, 121', 123 and 123' lies in the function of opening 139. Opening 139 is tapped in actuator members 121 and 121', with the tapped opening being referenced 139' to distinguish it from opening 139 in actuator members 123 and 123', which opening is defined by a smooth surface. The diameter of the untapped opening 139 is slightly greater than the diameter of the tapped opening 139'.

Rods 117 and 119, which are of like construction, each have a threaded end 157, such as indicated by threads 145 on rod 119, and the opposite end 159 may include a slot 147 for receiving a screwdriver.

A compression spring 149 is centrally disposed in opening 115 of extrusion 105, and actuator members 121 and 123 have their projections 137 disposed through elongated slots defined by opposite sides of extrusion 105, such as through the hereinbefore mentioned elongated slot 143, and through an elongated slot 151. Rod 117 is disposed in opening 115 of extrusion 105 with its threaded end 157 disposed through the enlarged opening 139 of actuator member 123. The threaded end 157 is then threadably engaged with the tapped opening 139' in actuator member 121. In like manner, actuator members 121' and 123' have their projections disposed through elongated slots 153 and 155, respectively, defined by extrusion 105. Rod 119 is disposed in opening 115 with its threaded end 157 disposed through smooth opening 139 in actuator member 123' and into threaded engagement with the tapped opening 139' in actuator member 121'.

Simultaneously manually actuating an actuator member from each of the first and second pairs 62 and 63 of actuator members towards one another, from either side of slidable panel member 104, such as by manually actuating members 123 and 121' towards one another, will overcome the bias of spring 149 and cause rods 117 and 119 to retract from openings formed in stiles 74 and 76 of frame 70, such as opening 161 formed in the web 163 of stile 74, allowing slidable panel member 104 to be moved vertically downward from the closed position shown in FIG. 3 to an open position. In like manner, manually actuating actuator members 121 and 123' towards one another will also unlock slidable panel member 104 and allow it to be moved from the fully closed position to an open position.

Figure 6:
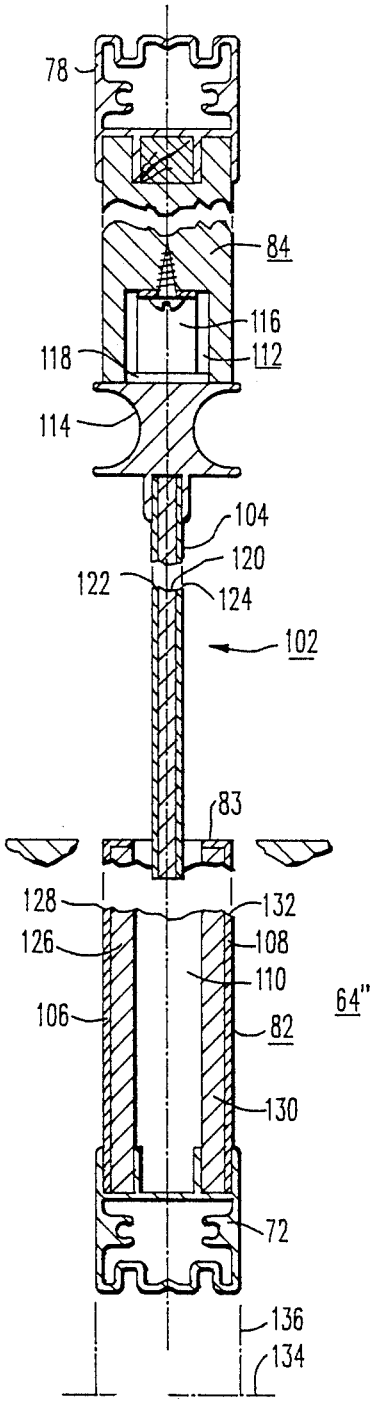
FIG. 6 is a cross-sectional view of the barrier panel shown in FIG. 3, except illustrating another panel latching arrangement may be used.
Figure 7:
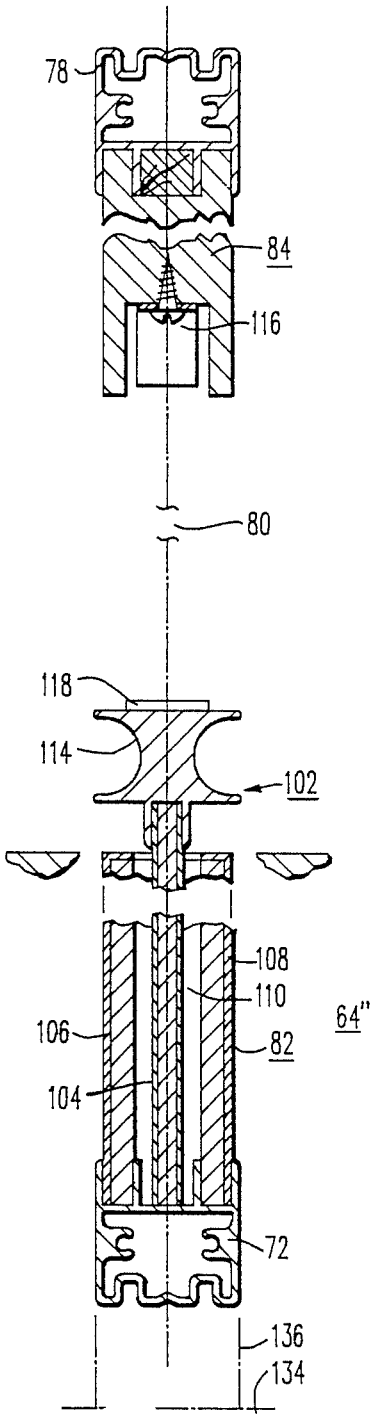
FIG. 7 is a cross-sectional view of a barrier panel similar to that shown in FIG. 6, except with a convertible panel member in an open position.

FIG. 6 is a cross sectional view of a barrier module 64'' which is similar to barrier panel module 64' shown in FIG. 3, except a latch 112 is illustrated which differs from latching arrangement 103. The lower panel insert 82 includes first and second spaced panel portions 106 and 108, respectively, with the spacing defining a pocket 110 for receiving the vertically slidable panel member 104. FIG. 7 is similar to FIG. 64, except vertically slidable panel member 104 is shown in the fully open position, as opposed to the fully closed position shown in FIG. 6.

When panel member 104 is fully closed, latch 112 holds panel member 104 in the closed position. The force which holds panel member 104 closed is automatically overcome by application of an intentional downward force applied to panel member 104, such as facilitated by a handle 114. In this embodiment, latch 112 is of the magnetic type, including a magnet 116 and a magnetically cooperative member 118 constructed of ferro-magnetic material. If handle 114 is constructed of ferro-magnetic material, then a separate ferro-magnetic member 118 may not be required. Magnet 116 is shown attached to the upper fixed panel insert 84 and the ferro-magnetic member 118 is shown attached to the uppermost edge of panel 104 member, but their positions may be reversed.

As illustrated in FIGS. 6 and 7, panel portions 106 and 108 and panel member 104 may all have a hard base formed of wood or hardboard, for example, with a fabric covering, attached thereto which is selected to match the fabric used to cover the other panel members or walls of a work station. Thus, panel member 104 may have a base 120 and fabric 122 and 124 on its opposite major sides. In like manner, the first panel portion 106 may have hard base 126 with a fabric covering 128, and the second panel portion 108 may have a hard base 130 and a fabric covering 132. Also as illustrated in FIGS. 6 and 7, the bottom 72 of frame 70 may be elevated slightly above floor level 134, e.g., about 4 inches, by a baseboard 136 which is shown in phantom. Baseboard 136, as is well known in the art, may conceal panel height adjusters, electrical wiring, communications wiring, and the like.

In the embodiments of FIGS. 3, 6 and 7, the convertible slidable panel member 104 substantially disappears into pocket 110 in the lower panel insert 82 when panel member 104 is manually actuated to expose opening 80. The remaining Figures illustrate embodiments of the invention in which a pocket is formed in the vertically slidable panel member, with the lower panel insert partially disappearing into this pocket when the slidable panel member is actuated to expose opening 80.

Figure 9:
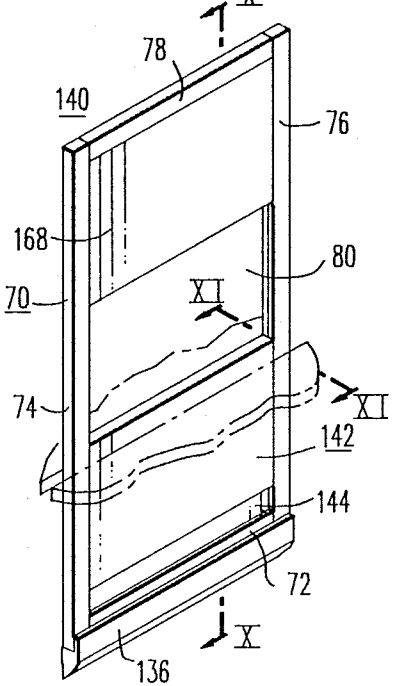
FIG. 9 is a perspective view similar to that of FIG. 8, except illustrating the convertible panel member in a fully open position.
Figure 8:
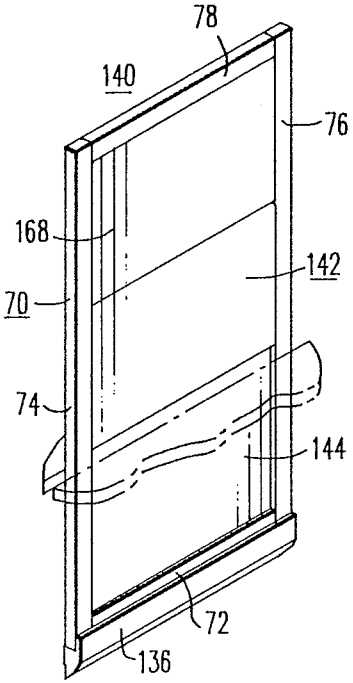
FIG. 8 is a perspective view of a barrier panel constructed according to another embodiment of the invention, illustrating a convertible panel member in a closed position.

More specifically, FIGS. 8 and 9 are perspective views which illustrate a barrier module 140 having a convertible or slidable panel member 142 in fully open and fully closed positions, respectively. Barrier module 140 includes a lower panel insert 144 disposed in open metallic frame 70. As shown in the cross sectional view of barrier module 140 in FIG. 10, which is taken between and in the direction of arrows X—X in FIG. 9, panel insert 144 may be held in a fixed position within frame 70 by an elastomeric element 146 which is snapped into grooves formed in the frame elements, or it may be slidable within frame 70, as will be hereinafter described. Unlike the lower panel insert 82 of the prior embodiment, lower panel insert 144 is constructed of a single piece of hardboard 148 having a suitable decorative covering, such as fabric 150.

Convertible panel member 142 is constructed to include a pocket 152 into which lower panel insert 144 extends. Thus, convertible panel member 142 may be similar in some respect to the construction of the lower panel insert 82 of the prior embodiments, having first and second spaced panel portions 154 and 156, with the spacing defining the pocket 152. Panel portion 154, for example, may include a frame formed of wood, such as frame elements 158 and 160, a light weight material 162 between the wood frame elements, such as foamed plastic, and a thin sheet 164 of hardboard over the inner side of the wood frame which aids in defining pocket 152. Panel portion 156 is constructed similar to panel portion 154, and the two panel portions 154 and 156 are separated by a spacer member 165. Spacer member 165 may have a resilient bumper 166 on its lower edge 167, for contacting the upper edge 169 of the lower panel insert 144 when convertible panel member 142 is moved downwardly to its fully open position.

When barrier module height exceeds 60 inches, an upper fixed panel insert 168 is provided. Unlike the lower panel insert 144, the upper fixed panel insert 168 is a full thickness insert, having a thickness dimension which matches the thickness dimension of convertible panel member 142. For example, the upper fixed panel insert 168 may have a wood frame around a hardboard septum, fiberglas filler and fabric covering.

Other types of latches which may be used to secure the slidable convertible panel member 142 in the position which closes barrier opening 80 are illustrated in FIGS. 10 and 11. As hereinbefore stated, FIG. 10 is a cross sectional view of slidable convertible panel member 142 taken between and in the direction of arrows X—X in FIG. 9. FIG. 11 is a cross sectional view of slidable convertible panel member 142 taken between and in the direction of arrows XI—XI in FIG. 9. As shown in FIG. 10, a quick release pull latch 170 may be used which has Velcro 171 attached to the upper edge of spacer member 165 and to the upper surface of a groove 172 formed in the lower edge 173 of upper panel insert 168. Groove 172 is dimensioned to receive an upper extension 175 of the convertible panel member 142, which is conveniently provided by spacer member 165, forming a sound and sight barrier when the convertible panel member 142 is pulled vertically upward to close opening 80 and cause upper extension 175 to enter groove 172.

Instead of Velcro 171, or in addition to the Velcro 171, a number of bullet catches may be used, such as bullet catches 174 and 176 shown in FIG. 11. Bullet catches may be placed at the upper and/or lower corners of the first and second panel portions 154 and 156, and in the spacer member or tie bar 165, as desired. Bullet catches, however, require closer tolerances for proper functioning than the latching arrangement 103 shown in FIGS. 3, 4 and 5, and thus latching arrangement 103 is preferred over bullet catches.

Also illustrated in FIG. 11 are plastic members 177 and 179 which are fixed to hardboards 164 and 164' such that they slidably engage frame stile 76. Similar plastic members are disposed at the opposite edge to slidably engage frame stile 74.

Figure 12:
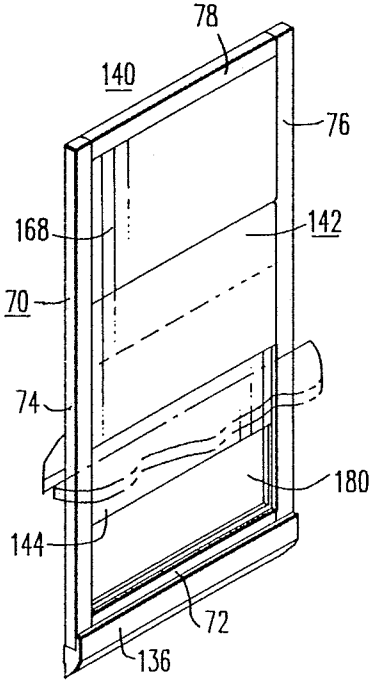
FIG. 12 is a perspective view of the barrier panel module shown in FIG. 8, illustrating a convertible panel disposed below the level of associated work surfaces.

FIG. 12 is similar to FIGS. 8 and 9, illustrating that the lower panel insert 144 may be raised upwardly into pocket 152, to selectively provide ventilation between work stations via the resulting opening 180, when desired. Barrier modules may thus be provided which:

(1) only have a communication access convertible panel, (2) only have a ventilation access convertible panel, or (3) which have both a communication access convertible panel and a ventilation access convertible panel.

When only a ventilation barrier module is required, panel member 142 and panel insert 168 may be constructed in one piece and fixed to frame 70.

Figure 13:
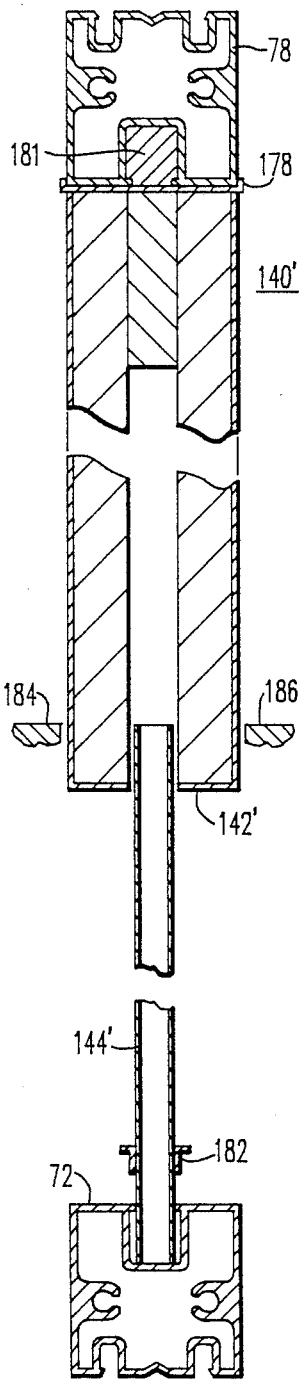
FIG. 13 is an elevational view, in section, of another embodiment of the invention, illustrating a barrier panel module having upper and lower convertible panels, both in their fully closed positions.
Figure 14:
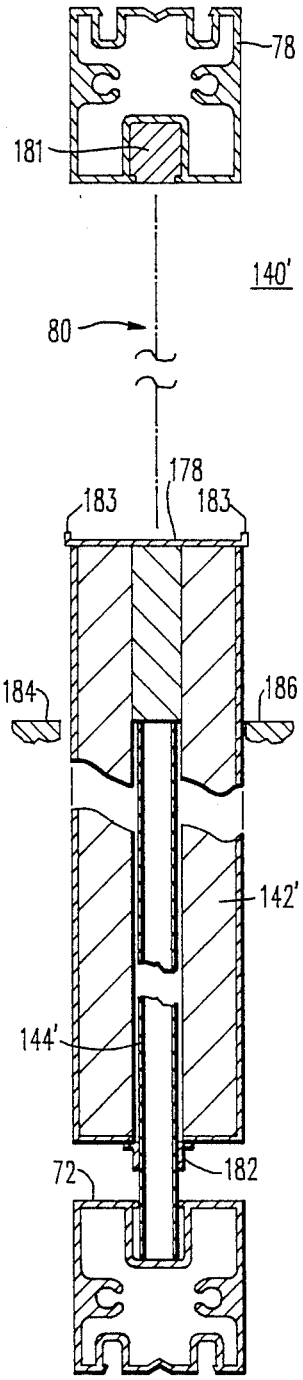
FIG. 14 is a view of the barrier panel shown in FIG. 13, illustrating the upper convertible panel in a fully open position.
Figure 15:
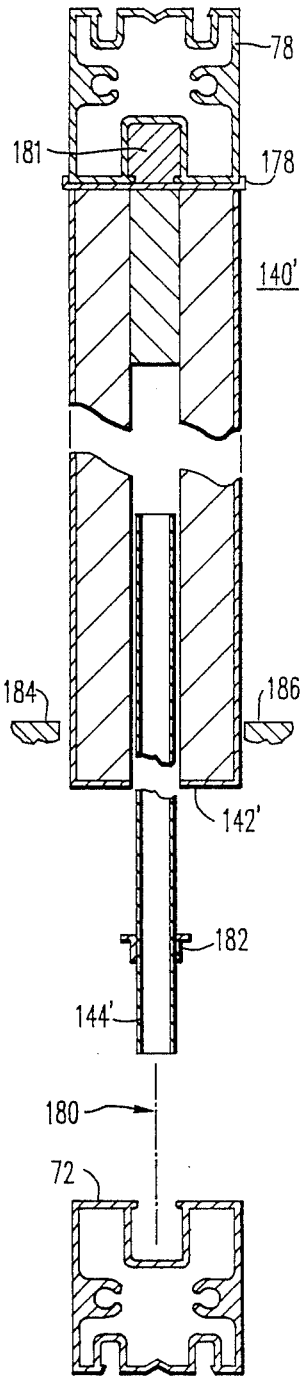
FIG. 15 is a view of the barrier panel module shown in FIG. 13 illustrating the lower convertible panel in an open position.

FIGS. 13, 14 and 15 are cross sectional views of a barrier module 140' which is similar to barrier module 140 shown in FIGS. 8 through 11, except illustrating a 60 inch high module which requires no upper fixed panel insert 84. FIG. 13 shows convertible panel member 142' in an uppermost position, closing an opening 80 located above work surfaces 184 and 186. FIG. 14 shows convertible panel member 142' in a lowered configuration, exposing opening 80. FIG. 15 shows the lower panel insert 144' raised to expose an opening 180 located near floor level. A small handle 182 may be provided on lower panel insert 144'.

For a latch, the top edge of convertible panel member 142 may be provided with a ferro-magnetic member 178 which is attracted and held by a magnet 181 carried by top frame member 78. In addition to functioning as a magnetic catch, or instead of functioning as a magnetic catch, ferro-magnetic member 178 may function as a spring type clip by extending sight barrier ears 183 and curving them into a clip configuration which cooperates with grooves (not shown) formed in top frame element 78.

In summary, as shown in FIG. 1, the three private work stations 14, 16, and 18 may be quickly converted to a conference room which includes any two, or all three work stations, by lowering the convertible panel members in each barrier module of each common wall. The convertible panel members, by vertically sliding into self-storing positions, will not become lost or damaged, such as may occur if they were removable. The convertible panel members do not swing out over work surfaces, and thus the work surfaces need not be disturbed to operate a convertible panel member. In the preferred embodiment of the invention, the convertible panel members slide downwardly to expose an opening in a barrier module, and thus, they cannot fall from an open to a closed position. The lowest panel inserts of a barrier panel module may be fixed to, or slidable in, the associated frame, as required, to open and close a ventilation opening located near the base of a barrier panel module.

We claim as our invention:

1. An office space dividing system comprising:
first and second work areas,
a barrier panel separating said first and second work areas,
said barrier panel having first and second sides adjacent to the first and second work areas, respectively,
an opening in the barrier panel which communicates with the first and second work are as,
convertible panel means,
means mounting said convertible panel means for slidable engagement with the barrier panel,
means accessible from either side of the barrier panel for operating said convertible panel means between first and second positions which open and close, respectively, the opening in the barrier panel,
and a substantially horizontally oriented work surface adjacent to at least one of the first and second sides of the barrier panel, and wherein the opening in the barrier panel is above the work surface.

2. An office space dividing system comprising:
first and second work areas,
a barrier panel separating said first and second work areas,
said barrier panel having first and second sides adjacent to the first and second work areas, respectively,
an opening in the barrier panel which communicates with the first and second work areas,
convertible panel means,
means mounting said convertible panel means for slidable engagement with the barrier panel,
means accessible from either side of the barrier panel for operating said convertible panel means between first and second positions which open and close, respectively, the opening in the barrier panel,
and first and second substantially horizontally oriented work surfaces disposed adjacent to the first and second sides of the barrier panel, respectively, and wherein the opening in the barrier panel is above said work surfaces.

3. As office space dividing system comprising:
first and second work areas,
a barrier panel separating said first and second work areas,
said barrier panel having first and second sides adjacent to the first and second work areas, respectively,
an opening in the barrier panel which communicates with the first and second work areas,
convertible panel means,
means mounting said convertible panel means for slidable engagement with the barrier panel,
means accessible from either side of the barrier panel for operating said convertible panel means between first and second positions which open and close, respectively, the opening in the barrier panel,
and a substantially horizontally oriented work surface adjacent to at least one of said first and second sides of the barrier panel, and wherein the opening in the barrier panel is below said work surface.

4. An office space dividing system comprising:
first and second work areas,
a barrier panel separating said first and second work areas;
said barrier panel having first and second sides adjacent to the first and second work areas, respectively,
an opening in the barrier panel which communicates with the first and second work areas,
convertible panel means,
means mounting said convertible panel means for slidable engagement with the barrier panel,
means accessible from either side of the barrier panel for operating said convertible panel means between first and second positions which open and close, respectively, the opening in the barrier panel,
and a substantially horizontally oriented work surface adjacent to at least one of said first and second sides of the barrier panel, with the opening in the barrier panel extending above and below said work surface, and wherein the convertible panel means includes first and second panel members disposed in slidable engagement with the barrier panel, with each having first and second positions which open and close, respectively, a portion of the opening above the work surface and a portion of the opening below the work surface.

5. The office space dividing system of claim 1 including:
a frame having top and bottom portions interconnected by first and second upstanding stiles, and including an opening in each of said first and second stiles,
with the convertible panel means being vertically slidable within said frame,
and wherein the means accessible from either side of the barrier panel for operating the convertible panel means includes a handle having first and second rods, bias means for urging said first and second rods into the openings in said first and second stiles when the convertible panel means is in the closed second position, and actuator means carried by said handle, said actuator means being manually operable for overcoming the bias of said bias means to retract said first and second rods from the openings in the first and second stiles when it is desired to slide the convertible panel means towards the open first position.

6. The office space dividing system of claim 5 wherein:

the actuator means includes first and second horizontally spaced pairs of actuator members, with each pair being disposed on opposite sides of the barrier panel, said first and second rods being operably carried by said first and second pairs of actuator members, respectively, the bias means is disposed between said first and second pairs of actuator members, and a member of each of the first and second pairs are actuatable towards one another, on either side of the barrier panel, to overcome the bias of the bias means.

7. The office space dividing system of claim 6 wherein each of the first and second pairs of actuator members include an actuator member having a tapped opening and an actuator member having a smooth opening which defines a diameter greater than the diameter of the tapped opening, with all of the actuator members, except for the opening, being similarly configured and dimensioned.

8. The office space dividing system of claim 1 wherein the convertible panel means is substantially concealed by the barrier panel when the convertible panel means is operated to the first position.

9. The office space dividing system of claim 1 wherein the convertible panel means is visible in both the first and second positions, while partially concealing the barrier panel in the first position.

10. The office space dividing system of claim 1 wherein the convertible panel means includes first and second panel members arranged for bi-parting vertical slidable movement, wherein the first and second panel members cooperatively open and close the opening in the barrier panel.

11. The office space dividing system of claim 10 wherein the barrier panel includes first and second pockets disposed above and below the opening in the barrier panel, respectively, with the first and second panel members being substantially concealed and stored in said first and second pockets, respectively, when the convertible panel means is in the first position.

12. The office space dividing system of claim 2 wherein the convertible panel means includes a single-panel member arranged for vertical slidable movement.

13. The office space dividing system of claim 12 wherein the barrier panel includes a pocket, with the single panel member being substantially concealed and stored in said pocket when the convertible panel means is in the first position.

14. The office space dividing system of claim 13 wherein the pocket in the barrier panel is below the opening in the barrier panel, such that gravity assists slidable movement of the single panel member into the pocket when the single panel member is manually moved to the first position.

15. The office space dividing system of claim 14 including latch means for automatically maintaining the single panel member in the second position, after the single panel member has been manually moved to the second position.

16. The office space dividing system of claim 15 wherein the means which operates the convertible panel means is manually actuated, with the latch means being automatically released when said operating means is manually actuated to move the single panel member from the second to the first position.

17. The office space dividing system of claim 13 wherein the pocket in the barrier panel is above the opening in the barrier panel, such that gravity assists slidable movement of the single panel member out of the pocket when the single panel member is manually moved to the second position.

18. The office space dividing system of claim 17 including latch means for automatically maintaining the single panel member in the first position, after the single panel member has been manually moved to the first position.

19. The office space dividing system of claim 18 wherein the latch means is automatically released when the means accessible from either side of the barrier panel is operated, to move the single panel member from the first to the second position.

20. The office space dividing system of claim 1 wherein the convertible panel means includes a single vertically slidable panel member having upper and lower edges, and a pocket therein accessible from the lower edge, and wherein the convertible panel means slides downwardly over the barrier panel as the convertible panel means is moved to the first position, concealing a portion of the barrier panel within said pocket.

21. The office space dividing system of claim 1 wherein the convertible panel means includes a single vertically slidable panel member having upper and lower edges, and a pocket therein accessible from the upper edge, and wherein the convertible panel means slides upwardly over the barrier panel as the convertible panel means is moved to the first position, concealing a portion of the barrier panel within said pocket.

22. The office space dividing system of claim 1 wherein the convertible panel means includes first and second lateral edges, and wherein the convertible panel means includes an open metallic frame having interconnected top, first and second side, and bottom metallic portions, and a fixed panel member captured by and fixed to said bottom and first and second side portions, with the means mounting the convertible panel means including recesses in the first and second metallic side portions which snugly but slidably receive the first and second lateral edges, respectively, of the convertible panel means.

23. The office space dividing system of claim 22 wherein the metallic frame includes a fixed panel member captured by and fixed to the bottom and first and second side portions of the metallic frame.

24. The office space dividing system of claim 22 wherein the first and second lateral edges of the convertible panel means each include plastic members which slidably engage the first and second side portions of the metallic frame.

25. The office space dividing system of claim 1 wherein the means mounting the convertible panel means mounts the convertible panel means such that it is non-removable from the barrier panel during normal usage.

26. An office space dividing system comprising:

first, second and third work stations having horizontally oriented work surfaces, first, second and third barrier panels arranged to separate said first, second and third work stations, each of said first, second and third barrier panels having first and second sides, with each of said first and second sides being adjacent to a work surface, an opening in each of said first, second and third barrier panels above the work surfaces, first, second and third convertible panel means, means mounting said first, second and third convertible panel means for slidable engagement with the first, second and third barrier panels, respectively, and means accessible from either side of each of said first, second and third barrier panels for operating the associated convertible panel means between first and second positions which open and close, respectively, the associated opening in the barrier panel.

* * * * *